United States Patent [19]

Moyer

[11] 4,075,458

[45] Feb. 21, 1978

[54] COMPACT HAIR CURLING IRON

[75] Inventor: Alan Ray Moyer, Natick, Mass.

[73] Assignee: The Gillette Company, Boston, Mass.

[21] Appl. No.: 703,580

[22] Filed: July 8, 1976

[51] Int. Cl.[2] ..... A45D 1/04; A45D 2/24; H01R 11/02; H05B 1/00

[52] U.S. Cl. ..... 219/225; 30/140; 30/161; 132/37 A; 132/143; 219/227; 219/533; 339/34; 339/58

[58] Field of Search ..... 219/221–242, 219/533; 132/37 R, 37 A, 31 R, 31 A, 32 R, 32 A, 33 R, 33 A, 33 B, 33 D, 33 E, 33 F, 33 G, 34 R, 34 A, 34 B, 34 C, 36 R, 36 AA, 36 C, 36 CC, 36 D, 41 R, 41 A, 7, 9, 117, 118, 143; 30/140, 153, 155, 161; 339/58, 34; 16/116 R

[56] References Cited

U.S. PATENT DOCUMENTS

| | | | |
|---|---|---|---|
| 427,907 | 5/1890 | Reid | 132/37 A |
| 1,549,776 | 8/1925 | Laufe | 132/37 A |
| 2,154,120 | 4/1939 | Berliner | 132/33 R |
| 3,586,820 | 6/1971 | Yamanaka | 219/242 X |

FOREIGN PATENT DOCUMENTS

| | | | |
|---|---|---|---|
| 380,338 | 9/1923 | Germany | 132/37 R |
| 413,944 | 6/1946 | Italy | 132/32 R |
| 1,375,768 | 11/1974 | United Kingdom | 219/225 |

*Primary Examiner*—A. Bartis
*Attorney, Agent, or Firm*—Richard A. Wise; Oistein J. Bratlie; Donald E. Mahoney

[57] ABSTRACT

A hair curling iron is arranged to have a handle with a concave portion pivotally connected to a heatable hair curling assembly including a tubular member heated by an electrical heater means and a plug for conducting electrical current to the electrical heater means. The plug is pivotally mounted on the hair curling assembly to withdraw a cavity in the hair curling assembly. The hair curling assembly is arranged to fold into the concave portion of the curling iron handle to provide a convenient package for carrying in a pocket or purse.

5 Claims, 3 Drawing Figures

10
11
12
13
14
15
16
17
18
19
20
21
22
23
24
26
27
28
29
30
31
32
33
34
35
37
38
39
40
Spring
Temperature Indicator 13
15
21
23
24
25
26
30
31
32

13
14
15
21
23
24
26
28
30
31
33
34
35
37
38
III
Temperature Indicator

COMPACT HAIR CURLING IRON

BACKGROUND OF THE INVENTION

1. Field of the Invention

This invention relates to hair curling irons and more particularly to curling irons having a heatable hair curling assembly which folds into a concave portion of a curling iron handle.

2. Description of the Prior Art

Apparatus for curling hair comprising a tubular heat conducting member and a conformably-shaped compressive gripping element extending from one end of a handle and a plug connected to an electrical cord extending from an opposite end of the handle are well known in the prior art. An external surface of the tubular member is heated to a temperature suitable for curling hair by a heating element in thermal contact with the tubular member. A tress of hair is held against the tubular member by the compressive gripping element and then wrapped around the gripping element and the tubular member so that heat from the tubular member can cause the hair tress to adopt the shape of the tubular member.

At times, a user may wish to carry the curling iron in a pocket or purse to a place outside of the home. The length of the conventional curling iron consisting of the tubular member projecting from one end of the handle could exceed more than 30 cm. It will be appreciated that a long curling iron in combination with a cumbersome cord, which tends to become tangled and twisted, presents an inconvenient package for easy transportation. An attempt to reduce the length of the curling iron by telescoping the tubular member into the handle is disclosed in German Pat. No. 2,246,273 published Mar. 8, 1973, entitled "Curling Iron," and standing in the name of Sadao Shimizo, Toyko, Japan. However, the prior art does not disclose a portable curling iron having a plug and tubular member arranged to fold into a concave portion of a curling iron handle, thus eliminating the need for a cumbersome cord and providing a convenient package for carrying in a purse or pocket.

Accordingly, a hair curling iron is disclosed in which a plug and tubular member are connected to a mounting member so that they may fold into a concave portion of a curling iron handle.

SUMMARY OF THE INVENTION

A hair curling iron comprises a handle having a concave portion, and a hair curling means including a elongated tubular member provided with an electric heating element for heating the tubular member, and a mounting member having a cavity, a first end and a second end. The first end of the mounting member is connected to an end of the tubular member. The second end of the mounting member is pivotally connected to the handle to permit the tubular member and the mounting member to fold into the concave portion of the handle. Plug means for conducting current to the electric heating element are connected to the mounting member to permit the plug means to withdraw into the mounting member cavity.

These and other features of the invention will be better understood from a consideration of the following specification taken in conjunction with the accompanying drawings.

DESCRIPTION OF THE PREFERRED EMBODIMENT

Figure 1:
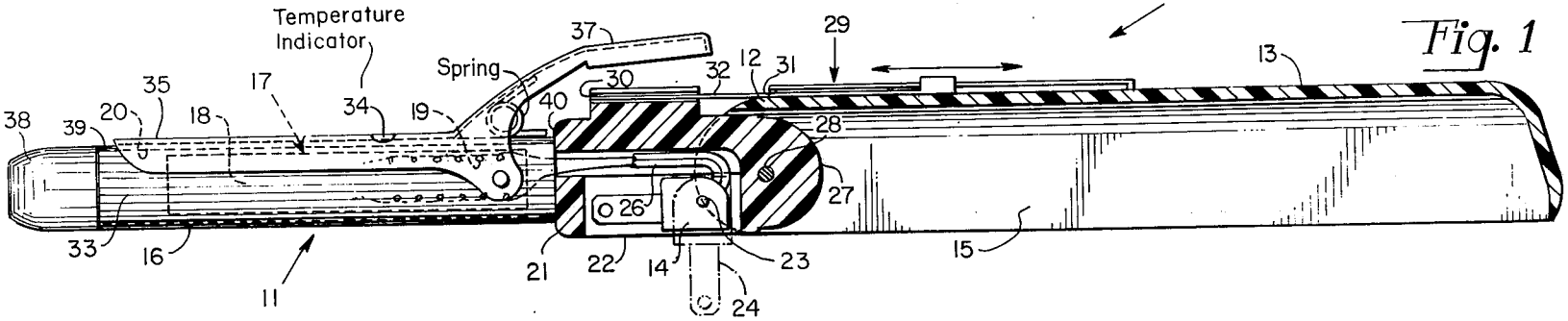
FIG. 1 is a longitudinal view, partially in section, of a preferred embodiment of the invention.
Figure 3:
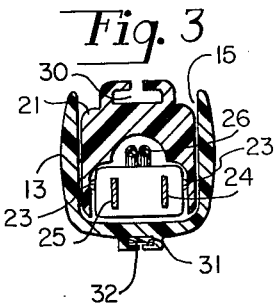
FIG. 3 is a cross-section of the hair curling iron in a compact condition.
Figure 2:
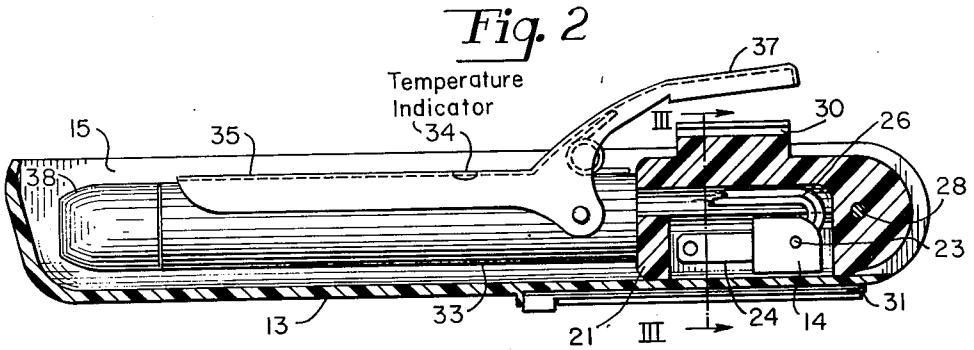
FIG. 2 is a longitudinal view, partially in section, of the hair curling iron in a compact condition.

Referring to FIG. 1, there is shown a longitudinal view, partially in section, of a hair curling iron 10 having hair curling means comprising a heatable hair curling assembly and a mounting member 21 extending from an end 12 of a handle 13. The hair curling assembly 11, mounting member 21 and an electrical plug 14 are arranged to fold into a concave portion 15 of the handle 13 to provide a convenient package for carrying in a pocket or purse (FIGS. 2 and 3). The hair curling assembly 11 comprises a heat conducting tubular member 16 and an internally disposed prior art electric heating element 17 for converting electrical energy to thermal energy. As an example, the heating element 17 may include a core 18 of heat conducting and electrically insulating material supporting a coil 19 of resistive wire. The core 18 is designed to provide a thermal path to the tubular member 16 by being in frictional contact with an internal wall 20 of the tubular member 16. The hair curling assembly 11 is connected to one end 40 of a mounting member 21 having a cavity 22. The plug 14 is pivotally attached to the mounting member 21 by a pivot pin 23 shown so that the plug 14 may pivotally move from a position where plug conductors 24 and 25 project outwardly from the mounting member 21 (shown in phantom) to a position where the plug 14 and plug conductors 24 and 25 are received in the cavity 22. A cable 26 is connected to provide a current conducting path between the plug conductors 24 and 25 and the coil 19 of resistive wire in the heating element 17.

The handle 13 is pivotally attached to an end 27 of the mounting member 21 by a pivot pin 28 so that the curling assembly 11 and plug 14 may fold or pivotally move into the handle concave portion 15, as shown in FIGS. 2 and 3. When unfolded and ready for use, a locking assembly 29 is arranged to hold the handle 13 substantially colinear with the curling assembly 11. The locking assembly 29 comprises a slot 30 in the mounting member 21, a slot 31 in the handle 13, and a locking bar 32 designed to slide forwardly from the handle slot 31 to the mounting member slot 30 to provide a bridge between the mounting member 21 and handle 13. The plug 14 is pivotally moved from the mounting member cavity 22 so that the plug conductors 24 and 25 project outwardly from the mounting member 21. The coil 19 of resistive wire conducts current and generates heat when the outwardly projecting plug conductors 24 and 25 are connected to a source of electrical energy such as a receptacle, not shown. The heat generated by the coil 19 is conducted to an external surface 33 of the tubular member 16. When the external surface 33 of the tubular member 16 reaches a temperature suitable for curling hair, the plug 14 is disconnected from the receptacle. Means for indicating a hair curling temperature include a temperature sensitive disk 34 of thermally sensitive material which changes color from red to black when the tubular member surface temperature exceeds 130° C. The disc 34 may be visibly displayed on a conformably-shaped clamp 35 pivotally connected to the tubular member 16 near an end 36. The clamp 35 is spring biased to normally be in frictional contact with tube surface 33 but may be pivotally moved away from the tube surface 33 by depressing an upraised clamp end 37. A tress of hair inserted between the tubular member 16 and raised clamp 35 is held against the heated external surface 33 of the tubular member 16 when pressure on the clamp end 37 is released. The clamped tress of hair may be wound around the heated clamp 35 and tubular member 16 whereby the heated surfaces 35 and 33 cause the hair to become plasticized and adopt the shape of the tubular member 16. Several tresses of hair may be curled in this manner until the generated heat is finally dissipated, whereupon the heat generating cycle discussed above may be repeated.

After use, a tip 38 connected to an end 39 of the tubular member 16 and formed from heat insulating material, such as polysulfone is grasped by a user while moving the locking bar 32 rearwardly toward the handle 13 out of the mounting member groove 30 so that the curling assembly 11 and plug 14 may be folded into the handle concave portion 15. It will be appreciated that when folded, the overall length of the curling iron 10 is substantially reduced and no cumbersome cord or projecting plug are present. In addition, the folded handle 13 protects the hair curling assembly 11 and plug 14 from damage while being transported.

One embodiment of the invention has been shown and described by way of example only. Various other embodiments and modifications thereof will be apparent to those skilled in the art, and will fall within the scope of the invention as defined in the following claims.

What is claimed as new and desired to be secured by Letters Patent of the United States is:

1. A hair curling iron comprising:

a handle having a concave portion;

hair curling means including an elongated tubular member provided with an electric heating element for heating said tubular member, and a mounting member having a cavity, a first end and a second end, said first end of said mounting member being connected to an end of said tubular member, said concave portion of said handle being of such size as to receive and accommodate said tubular member and said mounting member, said second end of said mounting member being pivotally connected to said handle in such a manner as to permit said tubular member and said mounting member to be folded into said concave portion of said handle; and plug means for conducting current to said electric heating element, said cavity being of such size as to receive said plug means, said plug means being connected to said mounting member in such a manner as to permit said plug means to be moved between a first operative position wherein said plug means is extended outwardly of said cavity when said tubular member is unfolded from said concave portion of said handle whereby said plug means is accessible for connecting to a power source and a second inoperative position wherein said plug means is withdrawn within said cavity to permit said tubular member to be folded into said concave portion of said handle.

2. A hair curling iron according to claim 1, wherein concave portion of said handle folds over and covers said plug means.

3. A hair curling iron according to claim 1, further including locking means cooperating with said mounting member and handle for holding said hair curling means colinear with said handle in an unfolded condition of said tubular member.

4. A hair curling iron according to claim 3, wherein said locking means include a groove in said mounting member, a groove in said handle and a locking bar sliding in said grooves to provide a bridge between said handle and mounting means.

5. A hair curling iron comprising:

a tubular member for engaging said hair;

an electrical heating element for heating said tubular member;

mounting means having a cavity, a first end and a second end, said first end being connected to one end of said tubular member;

plug means for conducting current to said heating element, said plug means being pivotally connected to said mounting means in such a manner as to extend outwardly from said mounting member for connection to a source of electrical current in a first position and to withdraw within said cavity in said mounting means in a second position; and a handle having a concave portion, said handle being pivotally connected to said second end of said mounting means and arranged to fold over and cover said plug and tubular member with said mounting means and said tubular member being received in said concave handle portion when said plug is in said second position.

* * * * *